United States Patent [19]

Lok et al.

[11] Patent Number: 4,758,506

[45] Date of Patent: Jul. 19, 1988

[54] SINGLE COMPONENT COLD PRESSURE FIXABLE ENCAPSULATED TONER COMPOSITION

[75] Inventors: Kar P. Lok, Mississauga; Marcel P. Breton; John R. Fuller, both of Toronto, all of Canada

[73] Assignee: Xerox Corporation, Stamford, Conn.

[21] Appl. No.: 621,307

[22] Filed: Jun. 15, 1984

[51] Int. Cl.[4] ..... G03G 9/14

[52] U.S. Cl. ..... 430/903; 430/106.6; 430/111; 428/407

[58] Field of Search ..... 430/106.6, 903, 111; 428/407

[56] References Cited

U.S. PATENT DOCUMENTS 3,965,022 6/1976 Strong et al. ..... 430/106.6

4,265,994 5/1981 Hasagawa et al. ..... 430/107

*Primary Examiner*—J. David Welsh

*Attorney, Agent, or Firm*—E. O. Palazzo

[57] ABSTRACT

Disclosed is an improved single component cold pressure fixable toner composition comprised of a core containing (1) magnetite particles, and a styrene-butadiene-styrene triblock polymer and a polymeric shell material generated by an interfacial polymerization process.

4 Claims, No Drawings

SINGLE COMPONENT COLD PRESSURE FIXABLE ENCAPSULATED TONER COMPOSITION

BACKGROUND OF THE INVENTION

This invention is generally directed to improved cold pressure fixable toner compositions, and more specifically the present invention is directed to single component pressure fixable encapsulated toners containing as a core component magnetite encapsulated by a polymeric shell prepared by interfacial polymerization. In one embodiment of the present invention there is provided a single component pressure fixable magnetic toner composition containing as a core a mixture of magnetite, and certain copolymer compositions, admixed with an organic solvent. This core is encapsulated with a pressure rupturable polymeric shell generated by interfacial polycondensation in an aqueous dispersion of reactants, wherein the surface of the magnetite core particles can be modified by chemical reaction with various stearates, including ammonium stearate, for the primary purpose of obtaining a desirable high concentration of well dispersed magnetite particles in the final toner composition. The toner compositions of the present invention are useful for causing the development of images in electrostatographic imaging systems, particularly electrostatic imaging systems wherein pressure fixing, especially pressure fixing without the presence of heat is selected.

The development of images, and in particular electrostatic images utilizing developer compositions containing toner materials is well known. In many of these systems an electrostatic latent image is formed on a photoconductor member, and the image is developed with a toner composition comprised of resin particles and carbon black. Subsequently the developed image is transferred to a suitable substrate wherein fixing is accomplished by heat. Accordingly final copies of the toner image are produced by heating the toner to a temperature at which it begins to flow enabling fusing of the particles to a support substrate such as paper. This fixing process generally requires substantial amounts of energy, and prior to producing the first copy in an apparatus with a heat pressure fixing system an appropriate temperature must be achieved for proper fusing. Other similar fixing systems are known including radiant, vapor, pressure, and combinations thereof.

Cold pressure fusing, also known, has a number of advantages primarily relating to the requirement for less energy, since the toner compositions involved can be fixed at room temperature. Nevertheless, many toner compositions used in prior art cold pressure fixing systems suffer from a number of deficiences. For example, these toner compositions must usually be fused under high pressure, and these pressures have a tendency to severely disrupt the toner fusing characteristics of the compositions selected. This results in images of low resolution or no images whatsoever. Also, in some of these systems substantial image smearing has been noticed in view of the high pressures required. While attempts have been made to improve toner compositions for cold pressure fix systems, these compositions in many instances have a number of undesirable characteristics, including agglomeration of particles at room temperature, insufficient flowability under high pressures, lack of adhesion to the support substrate such as paper, unsuitable blocking temperatures, and an insufficient brittleness to allow the preparation of such materials by, for example, known commerical jetting methods, or known fluid energy milling processes. Additionally, the cold pressure fixing toner compositions of the prior art have other disadvantages in that these comositions when used for development result in images with high gloss that are of low crease resistance and undesirable low smear resistance. Further the resulting images undesirably inhibit carbon-paper effect, that is there is a total or partial image transfer from the imaged substrate to neighboring substrates caused by pressures arising from normal handling. In some situations these disadvantage can be substantially eliminated by the use of certain coated papers. In contrast, images developed with the pressure fixable single component toner compositions of the present invention have a matte appearance on plain paper, are of high smear and crease resistance, and further there is substantially no carbon paper effect observed.

There is disclosed in U.S. Pat. No. 4,307,169, microcapsular electrostatic marking particles containing a pressure flexible core and an encapsulating substance comprised of a pressure rupturable shell, wherein the shell is formed by an interfacial polycondensation in an aqueous dispersion of reactants on and about the core. According to the disclosure of this patent, reference column 2 beginning at line 10, the microcapsular electrostatic marking particles are comprised of colored encapsulated pressure fixable substances contained within a pressure rupturable shell, and a residue thereover. Specifically, the ink selected for the toner composition of the U.S. Pat. No. 4,307,169 includes organic or inorganic pigments, magnetite, or ferrites, or other magnetizable substances, while the carrier medium for the ink may comprise a solvent or a plasticizer including for instance dibutylphthalate. The polyamide shell of the U.S. Pat. No. 4,307,169 is prepared by an interfacial polycondensation process. While the pressure fixable magnetic dry toner composition of the present invention is similar to that composition as described in the U.S. Pat. No. 4,307,169, it differs in a number of significant characteristics including, for example the user of a polymer in the core, which polymer is different in its composition and properties than the polymer selected for use in the U.S. Pat. No. 4,307,169. Thus, the polymer selected for the core of the present invention is a triblock polymer comprised of a polybutadiene segment, for example situated between two polystyrene segments. Accordingly, the morphology of this polymer is significantly different in its structure and properties than those materials disclosed in the U.S. Pat. No. 4,307,169, enabling the triblock polymer of the present invention to absorb and retain substantial amounts of low molecular weight additives, such as oils without phase separation under atmospheric pressure. Additionally, the polymers of the present invention enable the absorbed oil to be fully or partially desirably released under high pressure, the extent of this release being dependent for example on the pressure applied to the shell, the molecular weight of the triblock polymer, the ratio of styrene to butadiene in the polymer, and the molecular weight of the oils selected. Therefore, in xerographic imaging processes the released oil will assist in causing the polymer to penetrate and adhere to the paper substrate. Moreover, the unique morphology if the triblock polymer enables the production of desirable matte images.

Further there is disclosed in U.S. Pat. No. 4,407,922, pressure sensitive toner compositions comprised of a blend of two immiscible polymers selected from the group consisting of polymers of polystryene-co-stearylmethylacrylate as a hard component, and polyoctyldecylvinylether-co-maleic anhydride as a soft component, and a polyisobutylmethacrylate composition as a hard component, and polyoctyldecylvinylether-co-maleic anhydride as a soft component, wherein the soft component is present in an amount of from about 35 percent by weight to about 75 percent by weight, and the hard component is present in an amount of from about 25 percent by weight to about 65 percent by weight.

There thus continues to be a need for improved toner compositions, particularly dry toner compositions for use in imaging systems wherein cold pressure fixing processes are selected. More specifically there remains a need for single component cold pressure fixable dry toner compositions which exhibit excellent flowability at selected pressures, adhere to the substrate on which the image is to be permanently fixed, and wherein excellent images of high resolution result. Moreover there continues to be a need for improved encapsulated single component toner compositions wherein the image subsequent to fusing has a matte finish. Furthermore there continues to be a need for dry single component toner compositions wherein the shell can be prepared by interfacial polymerization processes. Also there continues to be a need for dry single component magnetic encapsulated toner compositions which possess desirable functional mechanical properties. Furthermore there continues to be a need for colored single component pressure fixable magnetic toner compositions wherein the magnetite particles are replaced with selected pigments including magenta, cyan, yellow, and the like. Also there is a need for encapsulated dry single component toner compositions which possess in combination excellent fixing characteristics, allow matte or nonglossy images with no carbon paper effect. Additionally there continues to be a need for encapsulated dry single component toner compositions which allow crease resistant images to be formed.

SUMMARY OF THE INVENTION

It is an object of the present invention to provide single component toner compositions which overcome several of the above noted disadvantages.

A further object of the present invention resides in the provision of single component pressure fixable toner compositions containing as a core magnetite, and certain polymer compositions.

In an additional object of the present invention there are provided single component magnetic dry pressure fixable toner compositions comprised of a core of colored pigment particles, and certain polymer compositions.

In yet an additional object of the present invention there are provided pressure fixable single component toner compositions containing a core of magnetite, and certain polymer compositions, encapsulated by a polymeric shell obtained by an insitu interfacial polymerization process.

A further object of the present invention resides in the provision of a single component magnetic dry pressure fixable toner composition containing as a polymer in the core a styrene-butadiene-styrene triblock coplymer, and as a shell a polyamide, or polyurea composition, which shell is generated by an insitu interfacial polymerization process.

An additional object of the present invention resides in the provision of dry single component pressure fixable toner compositions which when selected for use in developing images in electrostatic imaging systems allow final images of excellent resolution subsequent to fixing with pressure, and which does not cause substantial paper calendering.

In yet another object of the present invention there are provided single component magnetic toner compositions which when selected for the development of electrostatic images with pressure fusing processes allow the production of images with matte finishes on plain paper subsequent to fusing.

In a further object of the present invention there are provided single component magnetic toner compositions with a mechanical toughness that can withstand machine handling in the toner sump.

In a further object of the present invention there are provided single component magnetic toner compositions which when selected for the development of electrostatic latent images with pressure fusing processes there results images on plain paper with excellent smear and crease resistance.

In another object of the present invention there are provided single component magnetic toner compositions which when selected for the development of electrostatic latent images with pressure fusing processes there results images on plain paper with no carbon paper effect.

These and other objects of the present invention are accomplished by the provision of a single component dry pressure fixable toner composition with a core containing as a component certain polymeric compositions, encapsulated by a polymeric shell. More specifically in one embodiment there is provided in accordance with the present invention a pressure fixable single component magnetic toner composition comprised of a core mixture of magnetite, and a styrene-butadiene-styrene triblock copolymer, encapsulated with a polymeric shell generated by insitu interfacial polymerization processes. In one specific important embodiment of the present invention there is provided a dry single component magnetic toner composition containing a core comprised of a mixture of magnetite, a styrene-butadiene-styrene triblock copolymer composition, low molecular weight organic moieties, and an organic solvent, encapsulated by a polyamide shell, or a polyurea composition generated by interfacial polymerization processes. The magnetite in another preferred embodiment of the present invention can be modified by chemical reaction with various suitable substances, including stearates, such as ammonium stearate, for the purpose of obtaining a high concentration of magnetite suitably dispersed in the final toner composition.

The magnetic component contained in the toner core can be comprised of numerous suitable materials including those commercially available such as magnetite MO-7029, MO-8029, and MO-4431 available from Pfizer Corporation, Mapico Black magnetites available from Columbia Inc., Bayferrox magnetites available from Mobay Chemical, a mixture of iron oxides, and the like, with magnetite 7029, and 8029 being preferred. The magnetite is present in various effective amounts depending on the compositions of the other components, for example. Generally, however, from about 25 percent by weight to about 75 percent by weight of magnetite, and preferably from about 45 percent by weight to about 70 percent by weight of magnetite are present in the toner particle.

In one embodiment of the present invention the magnetite is surface treated by chemical reactions with various suitable substances including ammonium stearates. This treatment is effected primarily for the purpose of obtaining a high concentration of the dispersed magnetite in the final toner composition. More specifically, the chemical treatment is accomplished by heating the magnetite in the presence of a mixture of stearic acid and ammonium hydroxide. Subsequently the resulting magnetite is filtered, washed and dried. Thermogravimetric analysis and the hydrophobicity of the resulting material confirmed that the chemical modification was effective.

Various suitable polymers can be selected for incorporation into the core of the toner composition of the present invention, including styrene-butadiene-styrene triblock copolymers commercialy available from Shell Chemical Company as for example Kraton D-4240. These polymers are believed to be comprised of a styrene-butadiene polymer and allow an oil to be introduced therein as a plasticizer up to an amount of about 46 percent by weight. The oil is comprised of an aliphatic hydrocarbon containing relatively few aromatic moieties. In addition to the aliphatic oils other oils inclusive of unsaturated oils including polybutadienes, and polyethylene glycols, with molecular weights of from about 500 to about 5,400 can be used.

Other suitable polymers that can be selected include, for example, styrene-butadiene diblock copolymers, styrene-isoprene diblock copolymers, styrene-isoprene-styrene triblock polymers, alpha-methylstyrene-butadiene diblock copolymers, alpha-methylstyrene-butadiene-alpha-methylstyrene triblock copolymers, alpha-methylstyrene-butadiene-isoprene diblock copolymers, alpha-methylstyrene-isoprene-alpha-methylstyrene triblock copolymers, and the like.

The polymer is present in various effective suitable amounts, however generally from about 10 percent by weight to about 30 percent by weight of polymer, and preferably from about 15 percent by weight to about 25 percent by weight of polymer are incorporated into the core.

The toner compositions of the present invention, and in partiular the shell material, are prepared by interfacial polycondensation processes, as disclosed for example in U.S. Pat. No. 4,000,087, the disclosure of which is totally incorporated herein by reference. More specifically in the preparation of the polyamide, or polyurea polymer shell there is initially prepared an aqueous solution of an emulsion stabilizer such as polyvinyl alcohol, hydroxypropyl cellulose, poly(ethylene oxide-co-propylene oxide), or a hydroxyethylcellulose, followed by dispersing therein the core components to be encapsulated, thereby forming an emulsion. Subsequent to emulsification of the encapsulated substance a second reactive substance of an amine containing a diethylenetriamine in aqueous solution is added to the emulsion with agitation. The agitation is continued until the polycondensation polyamide, or polyurea product is formed as a shell at the interface between the emulsified droplets of the core components to be encapsulated and the water phase. This process is specifically described in U.S. Pat. No. 4,307,169, the disclosure of which is totally incorporated herein by reference.

The polymeric shell is of any suitable thickness providing the objectives of the present invention are achieved, however this thickness generally is from about 0.01 microns to about 1.0 microns, and preferably from about 0.05 microns to about 0.5 microns.

Subsequent to drying there is formed the single component magnetic cold pressure fix toner composition of the present invention.

In one specific embodiment of the present invention there is prepared a cold pressure fixable single component magnetic toner composition containing 10 to 20 percent by weight of a styrene-butadiene-styrene triblock copolymer, 50 percent by weight of magnetite MO-7029, or MO-8029 surface treated with from about one to about 5 percent by weight of ammonium stearate, and oil, encapsulated in a polyamide, or polyurea shell in a thickness of 0.5 microns.

The toner compositions of the present invention are useful for causing the development of electrostatic latent images, and more specifically in accordance with the present invention there is provided a method for developing electrostatic latent images which comprises forming the image on an imaging surface, such as known photoconductive members including selenium, selenium alloys, and the like, contacting the latent image with the developer composition of the present invention, followed by transferring the image to a suitable substrate such as plain bond paper, and affixing the image thereto by cold pressure fixing rollers generating pressures of from about 80 pounds per linear inch to about 200 pounds per linear inch, and preferably from about 100 pounds per linear inch to about 150 pounds per linear inch. Examples of cold pressure fixing processes and systems used include those available from Hitachi.

The following examples are being supplied to further define specific embodiments of the present invention, it being noted that these examples are intended to illustrate and not limit the scope of the present invention. Parts and percentages are by weight unless otherwise indicated. Additionally the Kraton polymers specified in the working examples are commerically available from Shell Chemical Company as porous pellets. More specifically the Kraton polymers selected were Kraton D-4240, a styrene-butadiene-styrene block copolymer (with a styrene/butadiene ratio of 44/56) plasticized with 46% oil (a Shellflex oil), Kraton D-4122 a styrene-butadiene-styrene block copolymer (with a styrene/-butadiene ratio of 48/52) plasticized with 35% oil, (A shellflex oil), Kraton DX-1115 a styrene-butadiene-styrene block copolymer (with a styrene/butadiene ratio of 38/62) with no oil, or plasticizer.

Further with regard to the following Examples the toner particles obtained had wrinkled surfaces caused by the removal of volatile organic solvents from the core material. Upon cold pressure fusing these toner particles assumed a flattened shape, coalesced with each other, and strongly adhered to paper. The microscopic surface features of the images areas however continued to exist in a roughened form, resulting in matte finishes. Also the level of fixing, or smearing was determined by a Taber Abraser, excellent smear indicating that the resulting developed images were essentially smear resistant. Crease refers to the amount of toner removed, as measured with a microdensitometer, from the solid image areas after repeated (over five) folding of the image sheet.

EXAMPLE I

Kraton D-4122 (Shell Chemical Co., Texas) 20 grams was dissolved in cyclohexane 50 grams. To the polymer solution was added a natural black oxide magnetite MO-8029 (Pfizer, New York, N.Y.) 30 grams, and the mixture was homogenized for 90 seconds with a Brinkmann homogenizer PT 10-35 set at speed 9, (generator PT 20). Terephthaloyl chloride (Aldrich, Wis.) 5 grams, was then dissolved in 20 ml, (milliliters) of methylene chloride. The resulting monomer was then added to the above mixture which was homogenized for an additional 45 seconds with a Brinkmann homogenizer PT 10-35 at speed 9, (generator PT 20). Thereafter the resulting core material was then dispersed into 500 ml of an aqueous solution containing 1% of polyvinylalcohol (88% hydrolyzed, Scientific Polymer Products, Ontario, N.Y.) 0.1% $Na_2CO_3$ (J. T. Baker, Phillipsburg N.J.), and 2-decanol (Aldrich, Wis.) 0.5 ml, by a Brinkmann homogenizer PT 10-35 at speed 7, (generator PT35/4) for 30 seconds. The reaction mixture was then transferred into a flask equipped with a mechanical stirrer. Diethylenetriamine (Aldrich, Wis.) 5 ml, in water 25 ml was added dropwise over 2 minutes to the dispersion. Stirring was continued for 3 hours, during which time an interfacial polycondensation reaction occurred between the terephthaloyl chloride and the diethylenetriamine. The volatiles were removed by heating at 65 degrees centrigrade overnight.

Once the solution was cooled to room temperature the toner composition resulting was settled with a magnet. The supernatant was removed and the toner was washed three times with water (3×500 ml). The toner was filtered through a 250 mesh sieve to eliminate any aggregates, (<less than 1%). To the filtrate (a one liter slurry) was added a flow agent, Cab-O-Sil HS-5 (Cabot, Toronto, Ont.) 0.2 grams (g). This slurry was then stirred for 15 minutes before spray drying on a Brinkmann Mini Spray Drier Model #190 (inlet temperature 120–130 degrees centigrade, outlet temperature 80–85 degrees centigrade) The spray dried toner microcapsules were free flowing with an average particle diameter size of 12.9 microns as determined by a Coulter Counter. This toner produced matte finish images on Xerox 4024 plain paper after cold pressure fixing at 125 pounds per linear inch, pli., with a Hitachi 3 roll fuser. The resulting images evidenced substantially no smearing (excellent smear) and excellent crease resistance. Electron microscopy indicated that the fused area exhibited complete coalescence of the imaged toner.

EXAMPLE II

Kraton D-4122 (Shell, Tex.) 20 grams, was dissolved in cyclohexane, 50 grams. To the resulting polymer solution was added an acicular brown gamma ferric oxide MO-2230 (Pfizer, New York N.Y.) 30 grams, and the mixture was homogenized for 90 seconds with a Brinkmann homogenizer PT 10-35 set at speed 9, generator PT 20 (cooled in cold water). Terephthaloyl chloride (Aldrich, Wis.) 5 grams, was dissolved in 20 ml of methylene chloride by warming with a heat gun. This monomer was then added to the above mixture, which was homogenized for 45 seconds with a Brinkmann homogenizer PT 10-35 set at speed 9, (generator PT 20). Thereafter the resulting core material was dispersed into 500 ml water containing 1% Polyvinylalcohol (88% hydrolyzed. Scientific Polymer Products, Ontario, N.Y.) 0.1% $Na_2CO_3$ (J. T. Baker, Phillipsburg, N.J.) and 2-decanol (Aldrich), 0.5 ml, by a Brinkmann homogenizer PT 10-35 at speed 7, (generator PT 35/4) for 30 seconds. The reaction mixture was then stirred mechanically. After 10 minutes diethylenetriamine (Aldrich, Wis.) 5 ml, in 25 ml of water was added dropwise over 2 minutes to the mixture. Stirring was continued for 3 hours, during which time an interfacial polycondensation reaction occurred between the terephthaloyl chloride and the diethylenetriamine at the interface, forming a shell material around the core. The volatiles were removed by heating at 65 degrees centigrade for a period of 16 hours. Once the solution was cooled to room temperature the resulting toner composition was settled with a magnet. The supernatant was removed and the toner was washed with water in a three times, (3×500 ml). The toner composition was then filtered through a 250 mesh sieve to remove any aggregates (less than 1%). To the filtrate slurry was added a flow additive 0.3 grams of (Cab-O-Sil) HS-5 (Cabot Tor., Ont.). This slurry was stirred for 15 minutes before spray drying on a Brinkmann Mini Spray Drier Model #190 (inlet temperature 120–130 degree centigrade, outlet temperature 80–85 degrees centigrade). The spray dried toner microcapsules were found to be free flowing and had an average particle diameter size of 14.5 microns. This toner possesses excellent fix after cold pressure fixing of 125 pli (pounds per lineal inch) using a Hitachi three-roll fuser. The resulting image had a matte finish and excellent smear and crease resistance.

EXAMPLE III

Kraton D-4122 (Shell, Tex.) 20 grams was dissolved in cyclohexane 50 grams. To the polymeric solution was added a synthetic magnetite Pfizer MO-7029 surface modified in-house with a stearic acid derivative, 30 grams and the mixture was homogenized for 90 seconds with a Brinkmann homogenizer PT 10-35 set at speed 9, (generator PT 20). Terephthaloyl chloride (Aldrich, Wis.) 5 grams was then dissolved in 20 ml of methylene chloride by warming. This monomer was then added to the above mixture, which was homogenized for an additional 45 seconds with a Brinkmann homogenizer PT 10-35 at speed 9, (generator PT 20). The resulting core material was dispersed into 500 ml of water containing 1% Polyvinylalcohol (88% hydrolyzed) (Scientific Polymer Products, Ontario, N.Y.). 0.1% $Na_2CO_3$ (J. T. Baker, Phillisburg, N.J.), and 0.5 ml 2-decanol (Aldrich, Wis.) with a Brinkmann homogenizer PT 10–35 at speed 7, (generator PT 35/4) for 30 sec. The core was then stirred mechanically. Diethylenetriamine (Aldrich, Wis.) 5 ml, in water 25 ml, was added all at once to the above dispersion. Stirring was continued for 2 hours, during which time an interfacial polycondensation reaction occurred between the terephthalolyl chloride and the diethylenetriamine resulting in a shell around the core material. The volatiles were removed by heating at 75 degrees centigrade for a period of 6 hours. Once the solution reached room temperature the toner was settled with a magnet. The supernatant was decanted and the toner was washed three times with water (3×1000 ml). Cab-O-Sil HS-5 (Cabot, Tor., Ont.) 0.3 grams was added to the toner dispersion. This slurry was then stirred for 15 minutes before spray drying on a Buchi Mini Spray-Drier 190 (inlet temperature 120–130 degrees centigrade outlet temperature 80–85 degrees centigrade). There resulted spray dried toner microcapsules. Electron microscopy indicated that the sample consisted of discrete microcapsular marking materials having a particle diameter size of about 18 microns.

EXAMPLE IV

Kraton D-4122 (Shell, Tex.) 20 grams was dissolved in cyclohexne 50 grams. A natural black oxide magnetite MO-8029 (Pfizer, New York, N.Y.) 30 grams, was added to the solution and the resulting mixture was homogenized for 90 seconds with a Brinkmann homogenizer PT 10-35 set at speed 9, (generator PT 20). 1,6-Diisocyanatohexane (Aldrich, Wis.) 4.2 grams, was then dissolved in 20 ml of methylene chloride, and added to the above mixture which was homogenized for another 45 seconds with a Brinkmann homogenizer PT 10-35 at speed 9, (generator PT 20). Thereafter the resulting core material was dispersed in 500 ml of an aqueous solution containing 1% of polyvinylalcohol (88% hydrolyzed) (Scientific Polymer Products, Ontario, N.Y.) and 0.5 ml 2-decanol (Aldrich, Wis.) using a Brinkman homogenizer PT 10-35 set at speed 7, (generator PT 35/4) for 30 seconds. While the dispersion was stirred mechanically, 5 ml of diethylenetriamine (Aldrich, Wis.), in 25 milliliters (ml) of water was added dropwise over 2 minutes. Stirring was continued for 3 hours, during which time a shell was formed by the interfacial polymerization of 1,6-diisocyanatohexane and diethylenetriamine. The volatiles were removed by heating at 65 degrees centigrade for a period of 16 hours. Once the reaction mixture had reached room temperature the resulting toner composition was settled with a magnet. The supernatant was decanted and the toner was washed with water three times (3×500 ml). The toner was filtered through a 250 mesh sieve to eliminate the small amount of aggregates (less than 1%). To the filtrate slurry was added a flow agent, Cab-O-Sil HS-5 (Cabot, Tor., Ont.) 0.3 grams. This slurry was stirred for 15 mintues before spray drying (inlet temperture 120–130 degrees centigrade, outlet temperature 80–85 degrees centigrade). The free flowing spray dried microcapsules were irregular in shape and had an average particle size of about 14 microns when viewed with an electron microscope.

EXAMPLE V

To a solution of Kraton D-4122 (Shell, Tex.) 20 grams dissolved in cyclohexane 50 grams was added a natural black oxide magnetite MO-8029 (Pfizer, New York, N.Y.) 30 grams, and the mixture was homogenized for 90 seconds with a Brinkmann homogenizer PT 10-35 set at speed 9, (generator PT 20). 1,3,5-Benzenetricarboxylic acid chloride, 500 grams (Aldrich, Wis.) was dissolved in 20 ml of methylene chloride. This monomer solution was then added to the mixture which was homogenized for an additional 45 seconds with a Brinkmann homogenizer PT 10-35 at speed 9, (generator PT 20). The core material obtained was dispersed into 500 ml of water containing 1% of polyvinylalcohol (88% hydrolyzed) (Scientific Polymer Products, Ontario, N.Y.) 0.1% $Na_2CO_3$ (J. T. Baker, Phillipsburg), and 2-decanol (Aldrich, Wis.) 0.5 ml by a Brinkmann homogenizer PT 10-35 set at speed 7 (generator PT 35/4) for 30 seconds. While the dispersion was stirred mechanically, 5 ml of diethylenetriamine (Aldrich, Wis.), in 5 ml of water was added dropwise over 2 minutes to the dispersion. Polymerization was allowed to continue for 3 hours, during which time an interfacial polycondensation polymer was formed between the two phases. The volatiles were removed by heating at 75 degrees centigrade for a period of 10 hours. Once the dispersion was cooled to room temperature the toner was settled with a magnet. The supernatant was removed and the toner was washed three times with water (3×-500 ml). The toner was filtered through a 250 mesh sieve. A flow agent Cab-O-Sil HS-5, 0.2 grams was added (Cabot Tor., Ont.) to the slurry. This slurry was stirred for 15 minutes and then spray dried (inlet temperature 120–130 degrees centigrade, outlet temperature 80–85 degrees centigrade). The spray dried toner fixed very well to Xerox 4024 plain paper after cold pressure fusing at 125 pli., with the Hitachi fixture disclosed herein.

EXAMPLE VI

Uvithane oligomer 783 (Thiokol, Trenton, N.J.) and Kraton D-4122 (Shell, Tex.) 20 grams were dissolved in toluene 50 grams. A natural black oxide magnetite MO-8029 (Pfizer, New York, N.Y.) 30 grams was added to this solution, and the resulting mixture was homogenized for 90 seconds with a Brinkmann homogenizer PT 10-35 set at speed 9, (generator PT 20) to insure the dispersion of the magnetite. A solution was then prepared by dissolving 4.2 grams of 1,6-Diisocyanatohexane (Aldrich, Wis.) in 20 milliliters of methylene chloride, followed by adding the resulting monomer solution to the above mixture, and homogenizing for 45 seconds with a Brinkmann homogenizer PT 10-35 speed 9, generator PT 20 (cooled in cold water). The core material that was obtained was then dispersed into 500 ml of water containing 1% polyvinylalcohol (88% hydrolyzed) (Scientific Polymer Products, Ontario, N.Y.) and 0.5 ml 2-decanol (Aldrich, Wis.) by a Brinkmann homogenizer PT 10-35 set at speed 7 (generator PT 35/4) for 30 seconds. While the dispersion was stirred mechanically 5 ml of diethylenetriamine, (Aldrich, Wis.), in 25 ml of water was added. Stirring was continued for 3 hours, during which time a shell was formed around the core material by the interfacial polymerization of 1,6-diisocyanatohexane and diethylenetriamine. Volatiles were removed by heating at 60 degrees centigrade overnight, and the resulting toner composition settled with a magnet. The supernatant was then removed, and the toner was washed with water three times (3×500 ml). Thereafter the resulting toner composition was filtered through a 250 mesh sieve enabling the removal of some aggregates (less than 1%). To the filtrate (a one liter slurry) was added a flow additive Cab-O-Sil HS-5 (0.2 grams, Cabot, Tor., Ont.). This slurry was then spray dried by a Buchi Mini Spray Drier 190 (inlet temperature 130–135 degrees centigrade, outlet temperature 80–85 degrees centigrade). The spray dried toner microcapsules had an average particle diameter size of about 12.1 microns. This toner fixes well to paper after cold pressure fixing at 125 pli with the Hitachi three-roll fuser. Moreover, the resulting images had a matte finish, and high smear and crease resistance.

EXAMPLE VII

To a solution of Kraton D-4122 (Shell, Tex.) 20 grams dissolved in cyclohexane 50 grams was added a natural black oxide magnetite MO-8029 (Pfizer, New York, N.Y.) 30 grams, followed by homogenizing for 90 seconds with a Brinkmann homogenizer PT 10-35 set at speed 9, (generator PT 20) to disperse the magnetite. Terephthaloyl chloride (Aldrich, Wis.) 5 grams dissolved in 20 ml of methylene chloride was added to the above mixture, which was further homogenized for an additional 45 seconds with a Brinkmann homogenizer PT 10-35 set at speed 9, (generator PT 20). The resulting core material was dispersed into 500 ml of water containing 1% polyvinylalcohol (88% hydrolyzed) (Scientific Polymer Products, Ontario, N.Y.) 500 ml, 0.1% $Na_2CO_3$ (J. T. Baker, Phillipsburg, N.J.) and 0.5 ml 2-decanol (Aldrich, Wis.) by a Brinkmann homogenizer PT 10-35 set at speed 7, (generator PT 35/4) for 30 seconds. While the dispersion was stirred mechanically, 5 ml, of p-phenylenediamine (Aldrich, Wis.), in 5 grams of water was added. Stirring was continued for 3 hours, during which time an interfacial polycondensation reaction occurred between the terephthaloyl chloride and the p-phenylenediamine to yield a shell around the core material. The volatiles were removed by heating at 65 degrees centigrade, and the resulting toner particles were settled with a magnet. Thereafter the supernatant was removed, and the resulting toner composition was washed with water three times (3×500 ml) and filtered through a 250 mesh sieve to remove aggregates. The slurry that was obtained was spray dried (inlet temperature 120–130 degrees centigrade, outlet temperature 80–85 degrees centigrade). The spray dried toner microcapsules were found to be free flowing with an average diameter particle size of 12.9 microns.

EXAMPLE VIII

Kraton D-4122 (Shell, Tex.) 20 grams was dissolved in cyclohexane 50 grams. To the polymer solution was added a natural black oxide magnetite MO-8029 (Pfizer, New York, N.Y.) 30 grams, followed by homogenizing the mixture for 90 seconds with a Brinkmann homogenizer PT 10-35 set at speed 9, (generator PT 20) to disperse the magnetite. Isonate 125 M (4,4'-diphenylmethane diisocyanate, (Upjohn, Tex.), 6.1 grams dissolved in 20 ml of methylene chloride was added to the above mixture which was further homogenized for 45 seconds with a Brinkmann homogenizer PT 10-35 set at speed 9, (generator PT 20). Thereafter the resulting core material was dispersed into 500 ml of water containing 1% polyvinylalcohol (88% hydrolyzed) (Scientific Polymer Products, Ontario, N.Y.) and 0.5 ml 2-decanol (Aldrich, Wis.) for 30 seconds with the Brinkmann homogenizer PT 10-35 at speed 7, (generator PT 35/4.) While the dispersion was being mechanically stirred, diethylenetriamine, (Aldrich, Wis.) 5 ml, in 25 ml of water was added dropwise over 2 minutes. Stirring was continued for 3 hours, during which time a shell was formed by the interfacial polymerization of isonate 125 M and diethylenetriamine. The volatiles were removed by heating at 65 degrees centrigrade for a period of 16 hours, and the resulting toner composition was settled with a magnet. Thereafter supernatant was removed, and the toner was washed with water three times (3×500 ml). The toner composition resulting was then filtered through a 250 mesh sieve and spray dried (inlet temperature 120–130 degrees centigrade, outlet temperature 80–85 degrees centigrade) yielding a cold pressure fixable magnetic toner having an average particle size of 13.3 microns in diameter.

EXAMPLE IX

Isonate 240 (Upjohn, Tex.) 5 grams and Kraton D-4122 (Shell, Texas) 15 grams were dissolved in cyclohexane 50 grams. A natural black oxide magnetite MO-8029 (Pfizer, New York, N.Y.) 30 grams was homogenized into the solution for 90 seconds with a Brinkmann homogenizer PT 10-35 set at speed 9, (generator PT 20). Isonate 125 M (4,4'-diphenylmethane diisocyanate) 6.1 grams dissolved in 20 ml of methylene chloride was then added to the above mixture. The resulting mixture was homogenized for an additional 45 seconds at speed 9, (generator PT 20). Thereafter the resulting core material was dispersed into 500 ml of an aqueous solution having dissolved therein 1% of polyvinylalcohol (88% hydrolyzed) (Scientific Polymer Products, Ontario, N.Y.) 500 ml, and 0.5 ml 2-decanol (Aldrich, Wis.) for 30 seconds Brinkmann homogenizer PT 10-35 set at speed 7, (generator PT 35/4). While the dispersion was being mechanically stirred diethylenetriamine (Aldrich, Wis.), 5 ml, in 25 ml of water was added. Stirring was continued for 3 hours, during which time a shell was formed by the interfacial polymerization of Isonate 125 M and diethylenetriamine. The volatiles were removed by heating at 65 degrees centigrade for a period of 16 hours, and the resulting toner omposition was settled with a magnet. Thereafter the supernatant was decanted off and the toner was washed with water three times (3×500 ml). The resulting toner composition was then filtered through a 250 mesh sieve prior to effecting spray drying (inlet temperature 120–130 degrees centigrade, outlet temperature 80–85 degrees centigrade). Images developed using this spray dried microencapsulated toner demonstrated good fix to paper after cold pressure fixing at 125 pli with the Hitachi three-roll fuser disclosed herein. This fuser roll was used for all fixing tests, unless otherwise indicated.

EXAMPLE X

Kraton D-4122 (Shell, Tex.) 20 grams was dissolved in 50 grams of toluene. To the solution that resulted was added a natural black oxide magnetite MO-8029 (Pfizer, New York, N.Y.) 30 grams, and the mixture was homogenized for 120 seconds with a Brinkmann homogenizer PT 10-35 set at speed 9, (generator PT 20). Isonate 125 M (4,4'-diphenylmethane diisocyanate) 10.9 grams dissolved in 20 ml of toluene was added to the above mixture which was homogenized for an additional 90 seconds with a Brinkmann homogenizer PT 10-35 set at speed 9, (generator PT 20). The core material obtained was dispersed into 500 ml of water with 1% polyvinylalcohol (88% hydrolyzed) (Scientific Polymer Products, Ontario, N.Y.) 500 ml. and 0.5 ml 2-decanol (Aldrich, Wis.) for 30 seconds with a Brinkmann homogenizer PT 10-35 set at speed 7, (generator PT 35/4). Diethylenetriamine (Aldrich, Wis.) 5 ml, in 25 ml of water, was added dropwise over 2 minutes to the dispersion. Stirring was continued for 3 hours, during which time a shell was formed by the interfacial polymerization of Isonate 125 M and diethylenetriamine. After the removal of the volatiles by heating at 75 degrees centigrade for a period of 10 hours the toner was settled with a magnet. The supernatant was decanted off and the toner was washed with water three times (3×500 ml). Thereafter the toner composition was filter through a 250 mesh sieve and spray dried (inlet temperature 120–130 degrees centigrade, outlet temperature 80–85 degrees centrigrade). The resulting spray dried toner microcapsules were found to be free flowing. This toner produced matte finish images with excellent fix quality after being cold pressure fixed to plain paper, in accordance with the process of Example IX.

EXAMPLE XI

To a solution of Kraton D-4122 (Shell, Tex.) 20 grams dissolved in cyclohexane 50 grams was added a natural black oxide magnetite MO-8029 (Pfizer, New York, N.Y.) 30 grams. The mixture was homogenized for 120 seconds with a Brinkmann homogenizer PT 10-35 set at speed 9, (generator PT 20). Papi 901, (polymethylene polyphenylisocyanates) (Upjohn, Tex.) 11 grams dissolved in 20 ml of methylene chloride was added to the above mixture which was again homogenized for 90 seconds with a Brinkmann homogenizer PT 10-35 set at speed 9, (generator PT 20). The resulting core material was dispersed into 500 ml of water containing 1% polyvinylalcohol (88% hydrolyzed) (Scientific Polymer Products, Ontario, N.Y.) and 2-decanol (Aldrich, Wis.) 0.5 ml by a Brinkmann homogenizer PT 10-35 set at speed 7, (generator PT 35/4) for 30 seconds. Diethylenetriamine (Aldrich, Wis.) 5 ml, in 25 ml of water was then added to the resulting mixture. Stirring was continued for 3 hours, during which time a shell was formed by the interfacial polymerization of Papi 901 and diethylenetriamine. The volatiles were removed by heating at 70 degrees centigrade for a period of 10 hours. Once the dispersion had reached room temperature the toner composition contained rtherein was settled with a magnet. Thereafter the supernatant was removed and the resulting toner composition was washed with water three times (3×500 ml). After filtration through a 250 mesh sieve and addition of 0.3 grams of a flow additive Cab-O-Sil HS-5 (Cabot, Tor., Ont.) the slurry was spray dried (inlet temperature 120–130 degrees centigrade, outlet temperature 80–85 degrees centigrade). The spray dried toner microcapsules were found to be free flowing and had an average particle size of 12.9 microns in diameter. This toner fixed well to paper with matte images being generated after cold pressure fixing at 125 pli on the Hitachi fuser at ambient temperature.

EXAMPLE XII

Kraton D-4240 (Shell, Tex.) 15 grams was dissolved in cyclohexane 50 grams. To the polymer solution was added a natural black oxide magnetite MO-8029 (Pfizer, New York, N.Y.) 30 grams and the mixture was homogenized for 90 seconds with a Brinkmann homogenizer PT 10-35 set at speed 9, (generator PT 20) to disperse the magnetite. Terephthaloyl chloride (Aldrich, Wis.) 5 grams, and Papi 901 (polymethylene polyphenylisocyanates) (Uphon, Tex.) 2.5 grams was dissolved in 20 ml of methylene chloride was added to the above mixture which was homogenized for 45 seconds with a Brinkmann homogenizer PT 10-35 set at speed 9, (generator PT 20). The core resulting material was dispersed in 500 ml of water containing 1% polyvinylalcohol (88% hydrolyzed) (Scientific Polymer Products, Ontario, N.Y.) and 0.1% $Na_2CO_3$ (J. T. Baker, Phillipsburg, N.J.) and 0.5 ml 2-decanol (Aldrich, Wis.) by a Brinkmann homogenizer PT 10-35 set at speed 5, (generator PT 35/4) for 30 sec. Diethylenetriamine, 5 ml (Aldrich, Wis.), in 25 ml of water was added dropwise over 2 minutes to the resulting dispersion Stirring was continued for 3 hours, during which time an interfacial polycondensation reaction occurred betwen the terephthaloyl chloride and the diethylenetriamine yielding a shell at the interface. The volatiles were removed by heating at 65 degrees centigrade for a period of 16 hours, and the toner composition resulting was settled with a magnet. Thereafter the supernatant was removed and the toner was washed with water three times (3×500 ml). The toner composition was then filtered through a 250 mesh sieve before spray drying (inlet temperature 120–130 degrees centigrade, outlet temperature 80–85 degrees centigrade). The spray dried toner microcapsules were found to be free flowing with an average particle size of 14 microns in diameter. This toner fixed well to paper, and matte images were generated after cold pressure fixing at 125 pli., with the Hitachi three roll fuser as disclosed herein.

EXAMPLE XIII

Kraton DX-1115 (Shell, Tex.) 20 grams, and Shellflex 680 oil (Shell Chemical) 5 grams was dissolved in cyclohexane 50 grams. To the solution was added a natural black oxide magnetite MO-8029 (Pfizer, New York, N.Y.) 30 grams and the mixture was homogenized for 90 seconds with a Brinkmann homogenizer PT 10-35 at speed 9, (generator PT 20). Terephthaloyl chloride (Aldrich, Wis.) 5 grams and Papi 901 (polymethylene polyphenylisocyanates) (Upjohn, Tex.) 2.5 grams was dissolved in 20 ml of methylene chloride. This monomer solution was then added to the above magnetite mixture, followed by homogenizing for an additional 45 seconds with a Brinkmann homogenizer PT 10-35 at speed 9, (generator PT 20). The core material obtained was then dispersed into 500 ml of water containing 1% polyvinylalcohol (88% hydrolyzed) (Scientific Polymer Products, Ontario, N.Y.) 500 ml, 0.1% $Na_2CO_3$ (J. T. Baker, Phillipsburg, N.J.) and 0.5 ml 2-decanol (Aldrich, Wis.) using a Brinkmann homogenizer PT 10-35 set at speed 7, (generator Pt 35/4). While the dispersion was stirred mechanically, 5 ml diethylenetriamine (Aldrich, Wis.), in 25 ml of water was added dropwise over 2 minutes. Stirring was continued for 3 hours, during which time an interfacial polycondensation reaction occurred between the terephthaloyl chloride and the diethylenetriamine resulting in a shell formed around the core material. The volatiles were removed by heating at 65 degrees centigrade for a period of 16 hours, and the cooled dispersion was settled with a magnet. Thereafter the supernatant was removed and the toner composition resulting was washed with water three times (3×500 ml) and spray dried (inlet temperature 120–130 degrees centigrade, outlet temperature 80–85 degrees centigrade). The spray dried toner microcapsules were found to be free flowing. The resulting toner composition fixed well to paper and offered a matte finish after cold pressure fixing at 125 pli., with the Hitachi three roll fuser as disclosed herein.

EXAMPLE XIV

To a solution of Kraton D-4240 (Shell, Tex.) 15 grams in cyclohexane 50 grams was added a natural black oxide magnetite MO-8029 (Pfizer, New York, N.Y.) 40 grams and the mixture was homogenized for 90 seconds with a Brinkmann homogenizer PT 10-35 at speed 9 (generator PT 20). A solution of terephthalolyl chloride (Aldrich, Wis.) 10 grams, and Papi 901 polymethylene polyphenylisocyanates (Upjohn, Tex.) 2.5 grams was prepared by dissolving these components in 20 ml of methylene chloride by warming. The resulting monomer solution was added to the above mixture, followed by homogenization for an additional 45 seconds with a Brinkmann homogenizer PT 10-35 at speed 9. The core material obtained was dispersed into 500 ml of water with 1% polyvinylalcohol (88% hydrolyzed (Scientific Polymer Products, Ontario, N.Y.) 500 ml, 0.1% $Na_2CO_3$ (J. T. Baker, Phillipsburg, N.J.) and 0.5 ml 2-decanol (Aldrich, Wis.) using a Brinkmann homogenizer PT 10-35 set at speed 5, (generator PT 35/4) for 30 sec. While the dispersion was stirred mechanically, 5 ml diethylenetriamine (Aldrich, Wis.) in 25 ml water was added dropwise over 2 minutes. Stirring was continued for 3 hours, during which time an interfacial polycondensation reaction occurred between the terephthaloyl chloride and the diethylenetriamine resulting in the formation of a shell. The volatiles were removed by heating at 65 degrees centigrade for a period of 16 hours. The cooled toner dispersion was then settled with a magnet. Thereafter the supernatant was removed and the resulting toner composition was washed with water three times (3×500 ml). The toner was filtered through a 250 mesh sieve. To the resulting slurry a flow additive Cab-O-Sil HS-5 0.2 grams (Cabot, Tor. Ont.) was added. This slurry was stirred at room temperature for 15 minutes before spray drying (inlet temperature 120–130 degrees centigrade, outlet temperature 80–85 degrees centigrade). The spray dried toner microcapsules were found to be free flowing with an average particle size of 11.1 microns. This toner fixed well to paper generating a matte image after cold pressure fixing at 125 pli., with the Hatachi three roll fuser as disclosed herein.

EXAMPLE XV

Kraton D-4240 (Shell, Tex.) 15 grams was dissolved in cyclohexane 50 grams. To this solution was added a natural black oxide magnetite MO-8029 (Pfizer, New York, N.Y.) 40 grams; and the mixture was then homogenized for 120 seconds with a Brinkmann homogenizer PT 10-35 set at speed 9 (generator PT 20). Terephthaloyl chloride (Aldrich, Wis.) 10 grams, and Papi 901 polymethylene polyphenylisocyanates (Upjohn, Tex.) 2.5 grams was dissolved in 20 ml of methylene chloride. The resulting monomer solution was then added to the above magnetite mixture, followed by further homogenization for 60 seconds with a Brinkmann homogenizer PT 10-35 at the same speed 9 (generator PT 20). The core material obtained was dispersed into 500 ml of water containing 1% polyvinylalcohol (88% hydrolyzed) Scientific Polymer Products, Ontario, N.Y.) 0.1% $N_2CO_3$ (J. T. Baker, Phillipsburg, N.J.) and 0.5 ml 2-decanol (Aldrich, Wis.) using a Brinkmann homogenizer PT 10-35 set at speed 7, (generator PT 35/4) for 30 sec. While the dispersion was being stirred mechanically, 5 ml of diethylenetriamine (Aldrich, Wis.), in 25 ml of water was added dropwise over 2 minutes. Stirring was continued for 3 hours, during which time a shell was formed around the core material by an interfacial polycondensation reaction occurring between the terephthaloyl chloride and Papi 901 with the diethylenetriamine. The volatiles were removed by heating at 65 degrees centigrade for a period of 16 hours. The dispersion was purified by washing with water three times (3×500 ml). Thereafter the resulting toner composition was filtered through a 250 mesh sieve and spray dried (inlet temperature 120–130 degrees centigrade, outlet temperature 80–85 degrees centigrade). The spray dried toner microcapsules were found to be free flowing with an average particle diameter size of 14.3 microns. This toner fixed well to paper with a matte image after cold pressure fixing at 125 pli., with the Hatachi three roll fuser as disclosed herein.

EXAMPLE XVI

To a solution of Kraton D-1115 (Shell, Tex.), 10 grams and Shellflex 310 oil (Shell Chemical) 3 grams was dissolved in 50 grams cyclohexane was added a natural black oxide magnetite MO-8029 (Pfizer, New York, N.Y.) 40 grams and the resulting mixture was homogenized for 100 seconds with a Brinkmann homogenizer PT 10-35 set at speed 9, (generator PT 20). Terephthaloyl chloride (Aldrich, Wis.) 10 grams and Papi 901, (polymethylene polyphenylisocyanate) (Upjohn, Tex.) 2.5 grams was dissolved in 20 ml of methylene chloride. The resulting monomer solution was then added to the above magnetite mixture, followed by further homogenization for 60 seconds with a Brinkmann homogenizer PT 10-35 at speed 9. (generator PT 20). The resulting core material was then dispersed into 500 ml of water containing 1% polyvinylalcohol (88% hydrolyzed) (Scientific Polymer Products, Ontario, N.Y.) 0.1% $Na_2CO_3$ (J. T. Baker, Phillipsburg, N.J.) and 0.5 ml 2-decanol (Aldrich, Wis.) using a Brinkmann homogenizer PT 10-35 at speed 7, (generator PT 35/4 for 30 seconds). While the dispersion was being stirred mechanically, diethylenetriamine (Aldrich, Wis.) 8 ml, in 22 ml of water was added dropwise over 2 minutes. Stirring was continued for 3 hours, during which time a shell was formed around the core material through an interfacial polycondensation reaction between the terephthaloyl chloride and Papi 901 with the diethylenetriamine. Thereafter the volatiles were removed by heating at 65 degrees centigrade for a period of 16 hours, and the dispersion was settled with a magnet. The dispersion obtained was then purified by washing with water three times (3×500 ml). The resulting toner composition was filtered through a 250 mesh sieve. A flow agent Cab-O-Sil HS-5 (0.3 grams) (Cabot. Tor., Ont.) was added to the slurry before spray drying (inlet temperature 120–130 degrees centigrade, outlet temperature 80–85 degrees centigrade). The spray dried microcapsules were found to be free flowing with an average particle diameter size of 15.2 microns. This toner fixed well to paper and a matte finish resulted after cold pressure fixing at 125 pli., with the Hatachi three roll fuser as disclosed herein.

EXAMPLE XVII

Kraton DX-1115 (Shell, Tex.) 10 grams, and Shellflex 680 oil (Shell Chemical) 3 grams were dissolved in toluene 50 grams. To the polymeric solution was added a natural black oxide magnetite MO-8029 (Pfizer, New York, N.Y.) 40 grams and the resulting mixture was homogenized for 100 seconds with a Brinkmann homogenizer PT 10-35 set at speed 9, (generator PT 20). Terephathaloyl chloride (Aldrich, Wis.) 10 grams and Papi 901, (polymethylenepolyphenylisocyanate) (Upjohn, Tex.) 2.5 grams was then dissolved in 20 ml of methylene chloride, and added to the above mixture, followed by further homogenization for 60 seconds with a Brinkmann homogenizer PT 10-35 at speed 9, (generator PT 20). The core material obtained was dispersed into 500 ml of water, containing 1% polyvinylalcohol (88% hydrolyzed) (Scientific Polymer Products, Ontario, N.Y.) 0.1% $Na_2CO_3$ (J. T. Baker, Phillipsburg, N.J.) and 0.5 ml 2-decanol (Aldrich, Wis.), by a Brinkmann homogenizer PT 10-35 at speed 5, (generator PT 35/4) for 25 seconds. While the dispersion was being stirred mechanically diethylenetriamine (Aldrich, Wis.) 8 ml, in water 22 ml, was added dropwise over 2 minutes. Stirring was continued for 3 hours, during which time a shell was formed at the interface through an interfacial polycondensation reaction between the terephthalolyl chloride and Papi 901 with the diethylenetriamine. The volatiles were removed by heating at 65 degrees centigrade for a period of 10 hours, and the toner compositionn was settled with a magnet. Thereafter the supernatant was removed, and the toner composition was washed with water three times (3×500 ml), filtered through a 250 mesh sieve and spray dried (inlet temperature 120–130 degrees centigrade, outlet temperature 80–85 degrees centigrade). The spray dried toner microcapsules were found to be free flowing with an average particle diameter size of 17.0 microns. This toner fixed well to paper and a matte finish was generated after cold pressure fixing at 125 pli., with the Hatachi three roll fuser as disclosed herein.

EXAMPLE XVIII

Kraton DX-1115 (Shell, Tex.) 10 grams, and poly(-propylene glycol) M.W. 400 (Scientific Polymer Products, Ontario, N.Y.) 3 grams were dissolved in cyclohexane 50 grams. To the solution was added a natural black oxide magnetite MO-8029 (Pfizer, New York, N.Y.) 40 gram;s and the mixture was homogenized for 100 seconds with a Brinkmann homogenizer PT 10-35 at speed 9, (generator PT 20). Terephthaloyl chloride (Aldrich, Wis.) 10 grams and Papi 901 (Upjohn, Tex.) 2.5 grams was then dissolved in 20 ml of methylene chloride. This monomer solution was then added to the above mixture, followed by further homogenization for 60 seconds with a Brinkmann homogenizer PT 10-35 at speed 9, (generator PT 20). The core material obtained was then dispersed into 500 ml of water having dissolved therein 1% polyvinylalcohol (88% hydrolyzed) (Scientific Polymer Products, Ontario, N.Y.) 500 ml, 0.1% $Na_2CO_3$ (J. T. Baker, Phillipsburg, N.J.) and 0.5 ml 2-decanol (Aldrich, Wis.) by a Brinkmann homogenizer PT 10-35 at speed 7, (generator PT 35/4) for 30 seconds. The core material dispersed in the water was stirred mechanically; diethylenetriamine (Aldrich, Wis.) 8 ml in water 22 ml was added dropwise over 2 minutes. Stirring was continued for 3 hours, during which time a shell was formed at the interface through an interfacial polycondensation reaction between the terephthaloyl chloride, Papi 901 with the diethylenetriamine. The volatiles were removed by heating at 65 degrees centigrade for a period of 16 hours, and the resulting toner composition was purified by washing with water three times (3×500 ml), filtered through a 250 mesh sieve and spray dried (inlet temperature 120–130 degrees centigrade, outlet temperature 80–85 degrees centigrade). The spray dried toner microcapsules were found to be free flowing, and were of an average particle size diameter of 14 microns. This toner fixed well to paper, and generated a matte finish after cold pressure fixing at 125 pli., with the Hatachi three roll fuser as disclosed herein.

EXAMPLE XIX

Kraton DX-1115 (Shell, Tex.) and polybutadiene M.W. 900 (Scientific Polymer Products, Ontario, N.Y.) 3 grams was dissolved in cyclohexane 50 grams. To the resulting solution was added a natural black oxide magnetite MO-8029 (Pfizer, New York, N.Y.) 40 grams and the mixture was homogenized for 100 seconds with a Brinkmann homogenizer PT 10-35 set at speed 9, (generator PT 20). Terephthaloyl chloride (Aldrich, Wis.) 10 grams and Papi 901 (Upjohn, Tex.) 2.5 grams was dissolved in 20 ml of methylene chloride. The resulting monomer solution was then added to the above mixture, followed by further homogenization for 60 seconds with a Brinkmann homogenizer PT 10-35 set at speed 9, (generator PT 20). The core material obtained was dispersed into 500 ml of water having dissolved therein 1% of polyvinylalcohol (88% hydrolyzed) (Scientific Polymer Products, Ontario, N.Y.) 0.1% $Na_2CO_3$ (J. T. Baker, Phillipsburg, N.J.) and 0.5 ml 2-decanol (Aldrich, Wis.) with the Brinkmann homogenizer PT 10-35 set at speed 7, (generator PT 35/4) for 30 seconds. The core material which was not dispersed in the water was stirred mechanically. After 10 minutes, diethylenetriamine (Aldrich, Wis.) 8 ml, in water 22 ml, was added dropwise over 2 minutes. Stirring was continued for 3 hours, during which time an interfacial polycondensation reaction occurred between the terephthaloyl chloride, Papi 901, and diethylenetriamine, resulting in the formation of a shell around the core material. The volatiles were removed by heating at 65 degrees centigrade for a period of 16 hours. The toner composition dispersion resulting was purified by washing with water three times (3×500 ml), filtered through a 250 mesh sieve and spray dried in the presence of 0.3 grams of Cab-O-Sil (Cabot, Ont.) (inlet temperature 120–130 degrees centigrade, outlet temperature 80–85 degrees centigrade). The spray dried toner microcapsules were found to be free flowing with an average diameter particle size of 15.2 microns. This toner composition fixed well to paper, and generated a matte finish after cold pressure fixing at 125 pli., with the Hatachi three roll fuser as disclosed herein.

EXAMPLE XX

To a solution of Kraton DX-1115 (Shell, Tex.) 10 grams, and there was added 3 grams of polybutadiene (M.W. 1500, Scientific Polymer Products, Ontario, N.Y.) in cyclohexane, 50 grams, followed by the addition of a natural black oxide magnetite MO-8029 (Pfizer, New York, N.Y.) 40 grams. This mixture was then homogenized for 100 seconds with a Brinkmann homogenizer Pt 10-35 set at speed 9, (generator PT 20). A solution of Terephthaloyl chloride (Aldrich, Wis.) 10 grams, and Papi 901 (Upjohn, Tex.) 2.5 grams, in 20 ml of methylene chloride was added to the above mixture, followed by further homogenization for an additional 60 seconds with the Brinkmann homogenizer. The core material obtained was dispersed into 500 ml of water having dissolved therein 1% of polyvinylalcohol (88% hydrolyzed) (Scientific Polymer Products, Ontario, N.Y.) 500 ml, 0.1% $Na_2CO_3$(J. T. Baker, Phillipsburg, N.J.), and 0.5 ml 2-decanol (Aldrich, Wis.) by a Brinkmann homogenizer PT 10-35 set at speed 7, (generator PT 35/4) for 30 seconds. The core material which was now dispersed in water was stirred mechanically. After 10 minutes, diethylenetriamine (Aldrich, Wis.) 8 ml, in water 22 ml, was added dropwise over 2 minutes. Stirring was continued for 3 hours, during which time an interfacial polycondensation reaction occurred between the terephthaloyl choride, and the diethylenetriamine yielding a shell around the core material at the interface. The volatiles were removed by heating at 65 degrees centigrade for a period of 16 hours, and the resulting toner composition was settled with a magnet, followed by removal of the supernatant. Thereafter the resulting toner composition was washed with water three times (3×500 ml), filtered through a 250 mesh sieve and spray dried (inlet temperature 120–130 degrees centigrade, outlet temperature 80–85 degrees centigrade). The spray dried toner microcapsules were found to be free flowing with an average particle size diameter of 18.0 microns. This toner fixed well to paper after cold pressure fixing at 125 pli., with the Hatachi three roll fuser as disclosed herein.

EXAMPLE XXI

Kraton DX-1115 (Shell, Tex.) 10 grams, and polybutadiene M.W. 900 (Scientific Polymer Products, Ontario, N.Y.) 3 grams, were dissolved in cyclohexane, 50 grams. To the polymer solution was added a natural black oxide magnetite MO-8029 (Pfizer, New York, N.Y.) 40 grams, and the mixture was homogenized for 100 seconds with a Brinkmann homogenizer PT 10-35 set at speed 9, (generator PT 20). A solution of Elate 160 (p-phenylene diisocyanate, Armak, Chicago), 10.0 grams, and Papi 901 (Upjohn, Tex.) 2.5 grams, dissolved in 20 ml of methylene chloride was added to the above mixture, which was then homogenized for an additional 60 seconds. The core material resulting was then dispersed into 500 ml of water having dissolved therein 1% of polyvinylalcohol (88% hydrolyzed) (Scientific Polymer Products, Ontario, N.Y.) and 0.5 ml 2-decanol (Aldrich, Wis.) by the Brinkmann homogenizer PT 10-35 at speed 7, (generator PT 35/4) for 30 seconds. While the core dispersion was being mechanically stirred, diethylenetriamine 8 ml, and water 25 ml, was added dropwise over 2 minutes. Stirring was continued for 3 hours, during which time a shell around the core material was formed by interfacial polymerization of p-phenylene diisocyanate, and Papi 901 with the diethylenetriamine. The volatiles were removed by heating at 70 degrees centigrade for a period of 8 hours. Thereafter the toner composition obtained was settled with a magnet, the supernatant was removed by washing with water three times (3×500 ml) and filtered through a 250 mesh sieve. A flow agent, 0.3 grams Cab-O-Sil HS-5 (Cabot, Tor., Ont.) was added to the slurry. This slurry was then stirred for 15 minutes before spray drying (inlet temperature 120–130 degrees centigrade, outlet temperature 80–85 degrees centigrade). The spray dried toner microcapsules were found to be free flowing with an averageaverage particle diameter size of 12.8 microns., This toner was tested in a single component development apparatus, commercially available as Cybernet CP55 imaging apparatus, using plain bond paper. The resulting images were of excellent fix, with high crease, and smear resistance. Moreover the images exhibited no carbon paper effect.

EXAMPLE XXII

To a solution of Kraton DX-1115 (Shell, Tex.) 10 grams, and polybutadiene M.W. 900 (Scientific Polymer Products, Ontario, N.Y.) 3 grams, dissolved in cyclohexane, 50 grams, was added a natural black oxide magnetite MO-8029 (Pfizer, New York, N.Y.) 40 grams. The mixture was homogenized for 100 seconds with a Brinkmann homogenizer PT 10-35 set at speed 9, (generator PT 20). A solution of 2,4-toluene diisocyante (Carbolabs, Bethany, CT) 10 grams, in 20 ml of methylene chloride was then added to the above mixture, which was homogenized for an additional 100 seconds with a Brinkmann homogenizer PT 10-35 at speed 9, (generator PT 20). The core material resulting was dispersed into 500 ml of water having dissolved therein 1% of polyvinylalcohol (88% hydrolyzed) (Scientific Polymer Products, Ont. N.Y.) and 0.5 ml 2-decanol (Aldrich, Wis) by the Brinkmann homogenizer PT 10-35 set at speed 5, (generator PT 35/4) for 30 seconds. While the dispersion was being stirred, diethylenetriamine, 5 ml (Aldrich, Wis.) 25 ml in water was added dropwise over 2 minutes. Stirring was continued for 3 hours, during which time a shell formed by interfacial polymerization of 2,4-toluene diisocyanate with diethylenetriamine. The volatiles were removed by heating at 65 degrees centrigrade for a period of 16 hours. Once the solution had reached room temperature the resulting toner composition was settled with a magnet. Thereafter the supernatant was removed, and the resulting toner composition was washed three times with water (3×500 ml). This toner composition was then filtered through a 250 mesh sieve. To the filtrate (a one liter slurry) was added a flow additive, 0.3 grams Cab-O-Sil HS-5 (Cabot, Tor., Ont.). This slurry was stirred for 15 minutes and spray dried (inlet temperature 120–130 degrees centigrade, outlet temperature 80–85 degrees centigrade). The spray dried toner microcapsules were found to be free flowing with an average particle diameter size of 11.3 microns. This toner fixed well to paper after cold pressure fixing at 125 pli.

Other modifications of the present invention will occur to those skilled in the art based upon a reading of the present disclosure. These are intended to be included within the scope of this invention.

We claim:

1. An improved single component cold pressure fixable toner composition consisting essentially of a core with from about 25 percent by weight to about 75 percent by weight magnetite particles, and a styrene-butadiene-styrene triblock polymer, encapsulated in a polymeric shell material generated by an interfacial polymerization process, wherein the magnetite is surface treated by a reaction with ammonium stearate.

2. An improved single component cold pressure fixable toner composition consisting essentially of a core with about 50 percent by weight of magnetite particles, and from about 10 percent by weight to about 20 percent by weight of a styrene-butadiene-styrene triblock copolymer; and wherein the magnetite is surface treated with from about 1 to about 5 percent by weight of ammonium stearate, said core being encapsulated in a polymeric shell generated by an interfacial polymerization process.

3. An improved composition in accordance with claim 2 wherein the thickness of the shell is from about 0.01 microns to about 1.0 micron.

4. An improved composition in accordance with claim 2 wherein the shell is a polyamide or a polyurea.

* * * * *